US006525703B1

(12) United States Patent
Salavin et al.

(10) Patent No.: US 6,525,703 B1
(45) Date of Patent: Feb. 25, 2003

(54) METHOD FOR CONTROLLING THE ADDRESSING OF AN AC PLASMA DISPLAY PANEL

(75) Inventors: Serge Salavin, St Egreve (FR); Philippe Zorzan, Grenoble (FR)

(73) Assignee: Thomson Tubes Electroniques, Meudon la Foret (FR)

( * ) Notice: Subject to any disclaimer, the term of this patent is extended or adjusted under 35 U.S.C. 154(b) by 0 days.

(21) Appl. No.: 09/331,892

(22) PCT Filed: Jan. 6, 1998

(86) PCT No.: PCT/FR98/00011

§ 371 (c)(1),
(2), (4) Date: Jul. 6, 1999

(87) PCT Pub. No.: WO98/31001

PCT Pub. Date: Jul. 16, 1998

(30) Foreign Application Priority Data

Jan. 7, 1997 (FR) ..... 97 00075

(51) Int. Cl.[7] ..... G09G 3/28

(52) U.S. Cl. ..... 345/68; 345/60; 345/67; 315/691.1; 315/169.3; 315/169.4

(58) Field of Search ..... 345/60, 63, 67–68, 345/55, 204; 315/169.1, 169.3, 169.4

(56) References Cited

U.S. PATENT DOCUMENTS 4,496,879 A * 1/1985 Suste ..... 315/169.4
4,650,434 A 3/1987 Deschamps et al. ..... 445/2
4,665,345 A * 5/1987 Shionoya et al. ..... 315/169.4
5,030,888 A 7/1991 Salavin et al. ..... 315/169.4
5,066,890 A 11/1991 Salavin et al. ..... 313/585
5,075,597 A 12/1991 Salavin et al. ..... 315/169.4
5,086,257 A 2/1992 Gay et al. ..... 315/169.4
5,237,315 A 8/1993 Gay et al. ..... 345/55
5,867,135 A 2/1999 Salavin et al. ..... 345/68
6,140,984 A * 10/2000 Kanazawa et al. ..... 345/67
6,160,529 A * 12/2000 Asao et al. ..... 345/60

FOREIGN PATENT DOCUMENTS

EP 0149381 A * 7/1985

OTHER PUBLICATIONS

T.N. Criscimagna et al., "Write and Erase Waveforms for High Resolution AC Plasma Panels" 1980 Biennial Display Research Conference, pp. 31–39, 1980.*

* cited by examiner

*Primary Examiner*—Richard Hjerpe
*Assistant Examiner*—Frances Nguyen
(74) *Attorney, Agent, or Firm*—Oblon, Spivak, McClelland, Maier & Neustadt, P.C.

(57) ABSTRACT

A control process for addressing an AC plasma panel. The panel includes line electrodes crossed with column electrodes where the intersections of these electrodes define cells. Sustain signals are applied to all of the line electrodes by way of at least one control circuit. The cells are addressed by superimposing supplementary voltage porches onto the sustain signals and then subsequently superimposing addresses pulses onto the supplementary porches. This method makes it possible to reduce the amplitude of the addressing pulses, thus resulting in a lesser demand on the control circuits resulting in a reduction of capacitive consumption.

25 Claims, 7 Drawing Sheets

SE
V2
V0
V1
td
10
p+
p-
5
9
11
t
P1
P2
P3
P4

SUSTAIN DISCHARGES
Id

Y1 ADDRESSING
VA
V5
IS
V3
V4
Tm
IE
IE'
t0
t1
t2

Y2 ADDRESSING
t3
t4

Y3 ADDRESSING
t5
t6

MASKING PULSE X2
IM

Y1 ADDRESSING

I1

I2

I3

I4

I5
CLOSED
OPEN

Y2 ADDRESSING

Y3 ADDRESSING

Y4 ADDRESSING
V4
V5
V2
V3
V0
V1
b1
b2
td1
td2
IS
IE
PS1
PS2
P1
P2
P3
P4
5
9
10
11

Y1 ADDRESSING

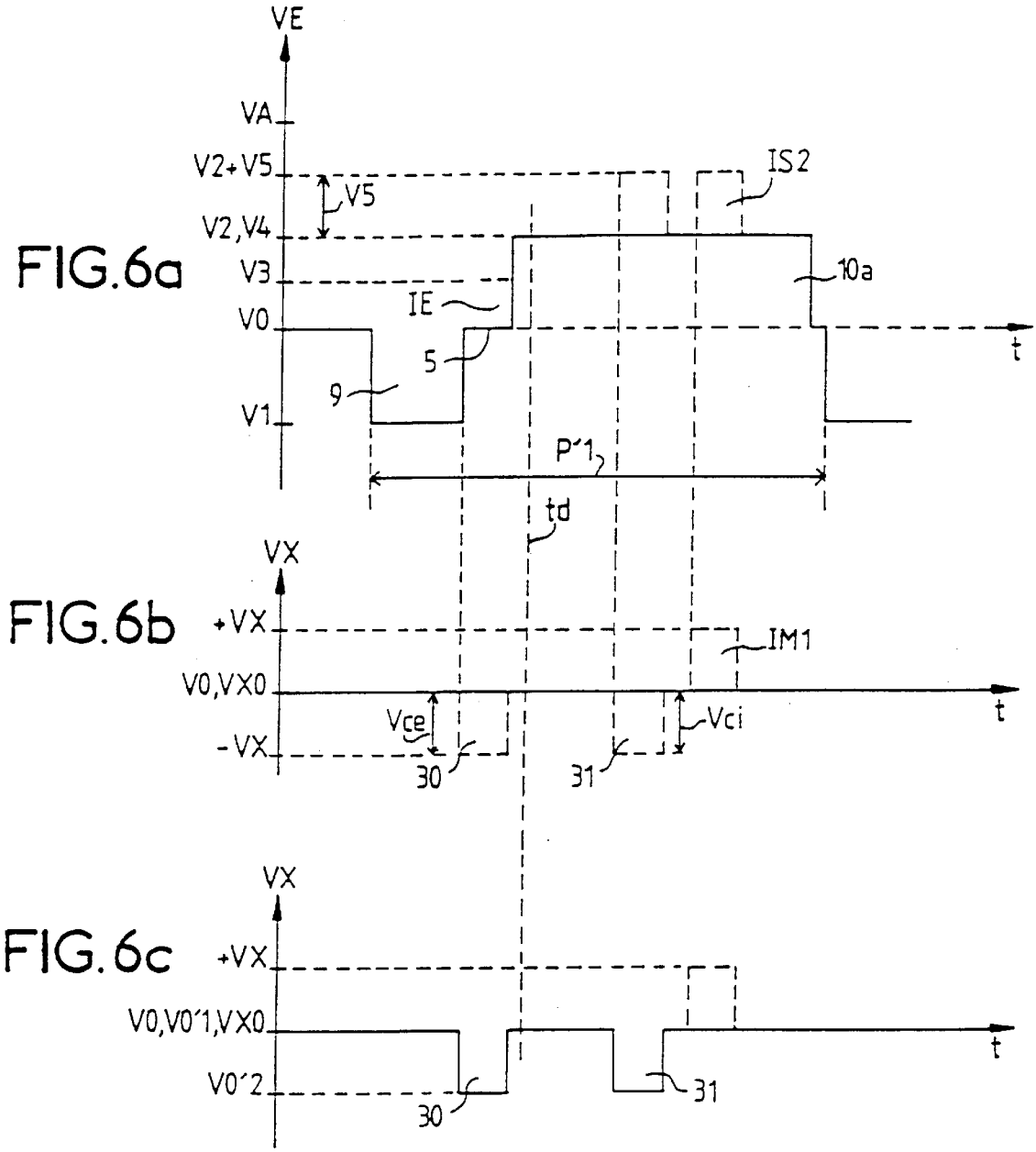
FIG.6a
FIG.6b
FIG.6c
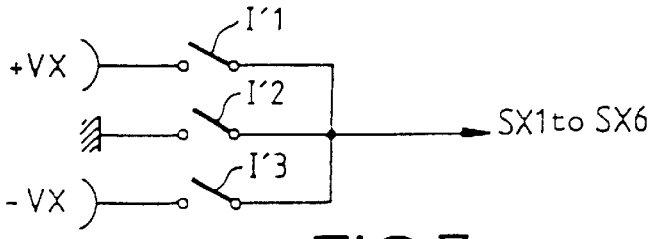
FIG.7

METHOD FOR CONTROLLING THE ADDRESSING OF AN AC PLASMA DISPLAY PANEL

BACKGROUND OF THE INVENTION

1. Fields of the Invention

The present invention relates to a control process for addressing an AC type plasma panel. For components used for addressing operations, its implementation makes it possible in particular to reduce the performance required from these components and hence to reduce their cost. The invention also relates to a plasma panel operating according to this process.

2. Discussion of the Background

Plasma panels or plasma screens, abbreviated to "PAPs" in the subsequent description, are flat display screens which use the emission of radiation in the visible or ultra-violet spectrum from a discharge in gases.

PAPs consist mainly of two large families, PAPs of the so-called DC type and PAPs of the so-called AC type. PAPs of the AC type, owing to their particular structure, benefit operationally from an effect referred to as the "memory effect" which renders them especially suitable in constructing large screens with a large number of elementary cells, both for professional applications and those aimed at the general public, such as for example high-definition colour television.

There are various types of AC PAP:

for example PAPs which use only two electrodes crossed to define a cell and to carry out its addressing and its activation, as described in French Patent 2 417 848:

or else AC PAPs of the so-called "coplanar sustain" type, known in particular through the European Patent document EP-A-0135 382, and in which each cell is defined at the crossing of a pair of so-called sustain electrodes with one or more other electrodes used more particularly for addressing the cells.

With AC PAPs, the addressing functions and those aimed at producing the light energy are separated: the production of light results from the "parallel" application to all the cells of a square-wave strobe signal referred to as the "sustain signal".

By contrast, the addressing of the cells demands that it be possible to control each line and each column of cells in an individualized manner. The electronic means serving to carry out these individualized controls are relatively complex and expensive, this being all the more penalizing as the market for PAPs moves towards ever larger panels.

The operation of an AC PAP is explained further hereafter with reference to FIG. 1. To simplify the explanations, the diagram shown in FIG. 1 is that of a PAP with two electrodes crossed to define a cell.

The PAP comprises a screen 1 formed with the aid of a network of electrodes Y1 to Y6 referred to as "line electrodes", which is crossed with a second network of electrodes X1 to X6 referred to as column electrodes. To each intersection of line and column electrodes there corresponds a cell C1 to C36. These cells are thus arranged along lines L1 to L6 and columns CL1 to CL6. In the example of FIG. 1, only 6 electrodes of each type are represented, but a PAP can include 1000 or more line electrodes and as many column electrodes, defining 1 million or more cells.

Each line electrode Y1 to Y6 is linked to a line output stage SY1 to SY6 of a line management device 2, and each column electrode X1 to X6 is linked to a column output stage SX1 to SX6 of a column management device 3. The operation of these two management devices 2, 3 is controlled by an image management device 4.

The line management device 2 comprises:

at least one circuit referred to as a sustain amplifier A1, producing signals referred to as "sustain signals" SE serving in activating the cells C1 to C36; given the sizeable power under which the SE signals may possibly have to be delivered, they may be supplied with the aid of a first and of a second amplifier A1, A2 as in the example shown;

it also includes in the non-limiting example represented, a first and a second line control circuit 6, 7 (which correspond to the circuits referred to as "line drivers" by experts in the field). In the simplified representation shown in FIG. 1 of the first and of the second line control circuit 6, 7, these latter respectively each comprise three switching stages M1 to M3 and M4 to M6 each linked to the input of a line output stage SY1 to SY3 and SY4 to SY6, in such a way that the first circuit 6 controls the first three line electrodes Y1 to Y3 and that the second circuit 7 controls the following three electrodes Y4 to Y6.

Each line control circuit 6, 7 is linked to one of the amplifiers A1, A2, from which it receives the sustain signals SE, and its function is in particular: on the one hand, to forward these signals SE in such a way that they are applied simultaneously to all the line electrodes Y1 to Y6 which it controls; its function is on the other hand, for the electrode or electrodes selected for an addressing operation, to superimpose either a so-called write pulse IS or a so-called erase pulse IE onto the sustain signals SE, depending on the type of addressing to be carried out.

The column management device 3 has in particular the function of applying, to the column electrodes X1 to X6, a reference potential, with respect to which so-called masking pulses IM are applied to some of these electrodes during addressing operations. To this end, it employs a column control circuit 8, similar for example to the line control circuits 6, 7, and comprising in the example, 6 switching stages M7 to M12 each linked to a column output stage SX1 to SX6, and which are responsible for formulating and switching the masking pulses.

In a PAP, each cell includes a gas-filled space. By applying a sufficient voltage referred to as the "turn-on voltage" VA between the two electrodes which define a given cell, an electric discharge is caused in the gas, giving rise to the emission of light by this cell. In an AC PAP, the electrodes are covered with a dielectric material. Accordingly, with each discharge into the gas, electric charges accumulate on the dielectric near the electrodes which define a cell within which the discharge occurs. These electric charges persist after the discharge and constitute an electric field referred to as the "internal memory field" specific to each cell, and make it possible, in respect of the cell which possesses it, to cause a discharge with the application of a voltage below the turn-on voltage. This effect constitutes the "memory effect" already mentioned. The cells which posseses such charges are said to be in the "written" or "on" state. To produce a discharge, the other cells demand a voltage equal to the turn-on voltage, they are said to be in the "erased" or "off" state.

The effect of applying the sustain signals SE is to activate the cells C1 to C36 which are in the "written" state, that is to say to cause discharges in these cells, without modifying their state or the state of the cells which are in the "erased"

state. The cells are set to the "written" state or the "erased" state depending on an image to be displayed, by addressing operations which are often carried out line by line, that is to say for all the cells C1 to C36 belonging to the same line L1 to L6 (or stated otherwise, for all the cells defined along the same line electrode Y1 to Y6), and then subsequently for all the cells of another line.

FIG. 2*a* represents sustain signals SE of a common type, which are intended to be applied to all the line electrodes Y1 to Y6. They consist of negative voltage strobes 9 and positive voltage strobes 10 established on either side of a reference potential V0 (which is often the potential of earth), and which follow one another with opposite polarities. They vary between a negative potential V1 where they exhibit a so-called negative porch p−, and a positive potential V2 where they exhibit a so-called positive porch p+. These negative and positive potentials V1, V2 have for example a value of 150 volts, which is added to the voltage produced by the internal memory field, so as to reach substantially the turn-on voltage value VA. According to a common form, the voltage transition which follows the end of a strobe 9; 10 can lead directly to the start of the following strobe, or else as in the example shown: on the one hand the negative strobes 9 are separated from the positive strobe 10 which follows by a wide intermediate porch 5, formed at the level of the reference potential V0 and intended to serve as base for an addressing pulse; and on the other hand, each positive strobe 10 is separated from the negative strobe which follows by a narrow intermediate porch 11, formed on the reference potential V0.

The reference potential V0 is applied to the column electrodes X1 to X6 in such a way that the application of each of the positive and negative strobes of the sustain signals SE to the line electrodes Y to Y6 develops at the terminals of the cells, alternating voltages of opposite signs, which give rise to so-called sustain discharges in all the cells which are in the "written" state.

FIG. 2*b* represents the phase relation between the sustain discharges Id in the cells C1 to C36, and the establishing of the strobes 9, 10. It may be seen that these discharges occur at instants td arising slightly after each start of the negative and positive porches p−, p+; in fact these discharges arise a few hundred nanoseconds after the establishment of these porches.

The strobes 9, 10 of the sustain signal SE follow one another with a period P1, P2, P3, P4 (commonly of the order of 20 microseconds), during which the addressing of all the cells defined by a elected line electrode (or by several in certain cases) is performed. The addressing operations are executed by the line and column control circuits 6, 7, which deliver specific signals for this purpose. The addressing consists, for the line control circuit 6, 7 and with the aid in particular of that of the switching stages M1 to M6 corresponding to the selected line electrode, in superimposing an erase pulse IE followed by a write pulse IS onto the sustain signal SE applied to this electrode.

FIGS. 2*c*, 2*d* and 2*e* respectively illustrate addressing operations performed on the cells of the line electrodes Y1, Y2 and Y3, which electrodes are controlled by the first line control circuit 6.

Assuming that the addressing of the line electrode Y1 is performed during a period P1 starting at an instant t0: the function of the signal applied solely to this electrode is to set all the cells of this electrode to the "erased" state. For this purpose, in the addressing form shown by way of example, a so-called erase addressing pulse IE, of positive polarity, is superimposed at an instant t1 on the wide intermediate porch 5 (that is to say the voltage corresponding to the amplitude of the pulse is added algebraically to the voltage onto which it is superimposed and hence which serves as base therefor) This erase pulse IE can exhibit a relatively slow rise time Tm, and its amplitude V4 is such that its summit reaches a value V3 referred to as the "erase voltage", slightly below for example the voltage V2 of the positive strobes 10. Such a signal, applied to the line electrode Y1 while the reference potential V0 is applied to all the column electrodes, causes a start of discharge in the cells which are in the "written" state, and its effect is to absorb the accumulated electric charges and hence eliminate the internal memory fields near all the cells.

Erasure can also be accomplished with the aid of an erase pulse IE' (represented dashed) superimposed t the instant t0 during the establishing of the negative strobe 9, and the shape of which makes it possible to confer a long time on this establishing time without modifying its amplitude. It should be noted that this addressing is accomplished under the action of the first switching stage M1 so as to be applied solely to the first line electrode Y1.

All the cells of the selected electrode Y1 having been erased, the next phase consists in setting to the "written" state only the selected cell or cells. To this end, a write pulse IS is superimposed on the sustain signal SE at an instant t2, on the positive porch p+. The pulse IS has an amplitude V5 such that with this superposition, the resulting voltage V2+V5 reaches a so-called write voltage value which is comparable with the turn-on voltage VA. If at this moment the potential delivered by all the column output stages SX1 to SX6, that is to say the potential applied to all the column electrodes X1 to X6, is that of the reference potential V0, the potential difference at the terminals of the cells C1 to C6 formed with the line electrode Y1 possesses the value of the turn-on voltage VA: accordingly, discharges occur in all the cells which consequently benefit from an internal memory field and are therefore in the "written" state.

To effect the selection of the cells, the column electrode management device 3 produces, with each write pulse IS, a "masking" sequence which consists in applying to those of the column electrodes X1 to X6 which define a cell having to remain in the "erased" state, a masking pulse IM in phase with the write pulse IS and the function of which is to prevent the potential difference at the terminals of these cells from reaching the turn-on value VA, and thus to disable the action of the write pulse IS.

FIG. 2*f* represents a masking pulse IM delivered on the second column electrode X2, at the instant t2, that is to say in phase with the write pulse IS applied to the first line electrode Y1. The masking pulse IM is positive, and its presence at this instant means that, at the end of the cycle for addressing the first line electrode Y1, the cell C2 retains an "erased" state.

FIG. 2*d* illustrates the addressing performed on the second line electrode Y2 (with the aid of the second switching stage M2), during a second period P2 which follows the first period P1. As in the previous case, the addressing starts with an erasing of all the cells (C7 to C12 in the present case) with the aid of an erase pulse IE, superimposed on a wide intermediate porch 5 at an instant t3, this being solely for the second line electrode Y2. Next, at an instant t4, a write pulse IS is superimposed on the positive porch 10 and causes all those cells of this line for which no masking pulse IM is applied to the corresponding column electrode X1 to X6 to be set to the "written" state. It should be noted that no masking pulse (FIG. 2*f*) being applied to the second column electrode X2 at the instant t4, the cell C8 is set to the "written" state.

FIG. 2*e* shows the addressings performed on the third line electrode Y3 (with the aid of the third switching stage M3), during a third period P3 which follows the second P2. At an instant t5, an erase pulse IE is superimposed on the wide intermediate porch p1. Next, at an instant t6, a write pulse IS is superimposed on the positive porch p+. The addressing (not represented) on the line electrodes Y4, Y5, Y6 is then performed in the same way, beginning with that of the electrode Y4 which is performed during the period P4.

The addressing operations described above are of two types: the addressing which consists in setting all the cells of the same line electrode to the same "erased" state without distinction, and of the "semi-selective addressing" type, and that which consists in setting selected cells to the "written" state and of the "selective addressing" type. However, semi-selective and selective addressings can also consist in setting all the cells of the same line to the "written" state for "semi-selective", and to the "erased" state certain selected cells, as far as "selective" is concerned. These explanations regarding the operation of an AC PAP highlight the importance, the large number and the complexity of the functions fulfilled by a line or column control circuit 6, 7 or 8. To cater for all these functions, these control circuits are themselves complex electronic components. The higher the performance demanded of these components, the more sophisticated and expensive are the technologies employed in their manufacture.

Among the technical characteristics which these control circuits must exhibit, those which relate to their capacity to deliver high voltage pulses are especially expensive to achieve. This is yet more pronounced as regards their ability to deliver, simultaneously on their various outputs, signals exhibiting large voltage differences, as is the case in the addressing operations, both in respect of the line control circuits 6, 7 which deliver addressing pulses IE, IS, and in respect of the column control circuit delivering masking pulses IM.

It should be observed that the line control circuits 6, 7 must exhibit technical characteristics of much greater performance in order to deliver the addressing pulses IS, IE than to deliver the sustain signals SE. This is because the latter are applied continuously to all the electrodes Y1 to Y6, they need not be selected or switched, they are formulated by the amplifiers A1, A2 and merely pass through the switching stages M1 to M6. The addressing pulses on the other hand use various complex electronic circuits so as to be constructed, selected, switched and superimposed on the sustain signals with the appropriate synchronism and appropriate rate, and with sufficient power to possibly give rise to discharges in a large number of cells simultaneously.

The importance of the problem raised by the cost of these control circuits is tending to increase further, on account in particular of the ever wider applications of PAPs to the displaying of large-size colour images, since the production of colours requires gas mixtures having higher turn-on (ignition) voltages VA.

SUMMARY OF THE INVENTION

One of the aims of the present invention is to allow the use, within AC PAPs, of line control and/or column control circuits exhibiting the lower cost.

Another purpose of the invention is to reduce the so-called capacitive consumption of AC PAPs. The capacitances exhibited by the various elements, such as for example the tracks which constitute the electrodes, the various connections, and the self-capacitances of the electronic circuits, form a relatively sizeable overall capacitance which consumes AC currents. The capacitive power PC dissipated by an addressing pulse is expressed through the following relation:

$PC=C\cdot Vi^2\cdot F$; where C is the capacitance seen by the pulse, Vi is the value of the voltage of the addressing pulse, F is the addressing frequency. This relation shows in particular that this capacitive power varies with the square of the amplitude of the pulse.

To achieve the aforementioned purposes, the invention proposes that the selective and/or semi-selective addressings be done in a manner which makes it possible to reduce the amplitude of the addressing pulses distributed by the control circuits 6, 7, 8.

The invention relates to a control process for addressing an AC plasma panel comprising at least one network of so-called "line" electrodes, crossed with at least one network of so-called column electrodes, cells being formed at the intersections of the line and column electrodes, the said process consisting in applying to all the line electrodes sustain signals formed of a succession of strobes having a given period and established with respect to a reference potential applied to the column electrodes, each period being able to constitute an addressing cycle comprising at least one addressing of the semi-selective type and at least one addressing of the selective type, each type of addressing consisting in applying to at least one selected line electrode a so-called addressing pulse whose voltage is added to a so-called line voltage already present on this electrode, with a view to applying to the terminals of cells formed by this selected electrode a so-called addressing voltage of given value corresponding to the addressing to be performed, the process being characterized in that for at least one of the two types of addressing, the addressing pulse has an amplitude below that which is appropriate for obtaining the required addressing voltage, and in that to obtain the said addressing voltage, it furthermore consists either in modifying the reference potential applied to the column electrodes, or in modifying the line voltage already present on the selected line electrode when the addressing pulse is applied, or alternatively in modifying this latter line voltage as well as the reference potential applied to the column electrodes.

The process according to the invention consists in superimposing at least one voltage porch referred to as the supplementary porch on the sustain signals during a period of these latter, in such a way as to constitute a voltage base referred to as the addressing base onto which is superimposed at least one addressing pulse.

The signals being formed of negative and positive strobes, the process according to the invention consists in forming a write addressing voltage base with a strobe, and of superimposing an addressing pulse consisting of a so-called write pulse onto this addressing base.

The process consists in establishing between two consecutive strobes an intermediate porch having a voltage below the voltage of the strobes, and in adding a supplementary porch to the said intermediate porch so as to constitute an erase addressing base, then in superimposing an addressing pulse consisting of an erase pulse onto this erasure base.

The intermediate porch is at the same voltage as the reference potential.

The supplementary porches added onto strobes are superimposed on these latter after an instant at which a so-called sustain discharge occurs.

The supplementary porches formed on strobes are deleted substantially at the end of these strobes.

The supplementary porches formed on strobes encompass the entirety of the pulse or pulses for addressing a selected line electrode.

The supplementary porches serving to constitute an erasure base have an amplitude equal to or greater than the difference between a so-called erasure voltage and the amplitude of the erase pulses.

The supplementary porches serving to constitute a write base have an amplitude equal to or greater than the difference between a so-called writing voltage and a voltage value formed by the sum of the voltage of a positive strobe and of the amplitude of a write pulse.

BRIEF DESCRIPTION OF THE DRAWINGS

The invention will be better understood and other advantages which it affords will become apparent on reading the description which follows of certain of its embodiments, which description is made by way of non-limiting example with reference to the appended figures in which:

FIGS. 6*a,* 6*b,* 6*c* illustrate a version of the invention consisting in modifying a potential applied to column electrodes;

FIG. 7 illustrates the manner of operation of a control circuit.

DETAILED DESCRIPTION OF THE PREFERRED EMBODIMENTS

Figure 1:
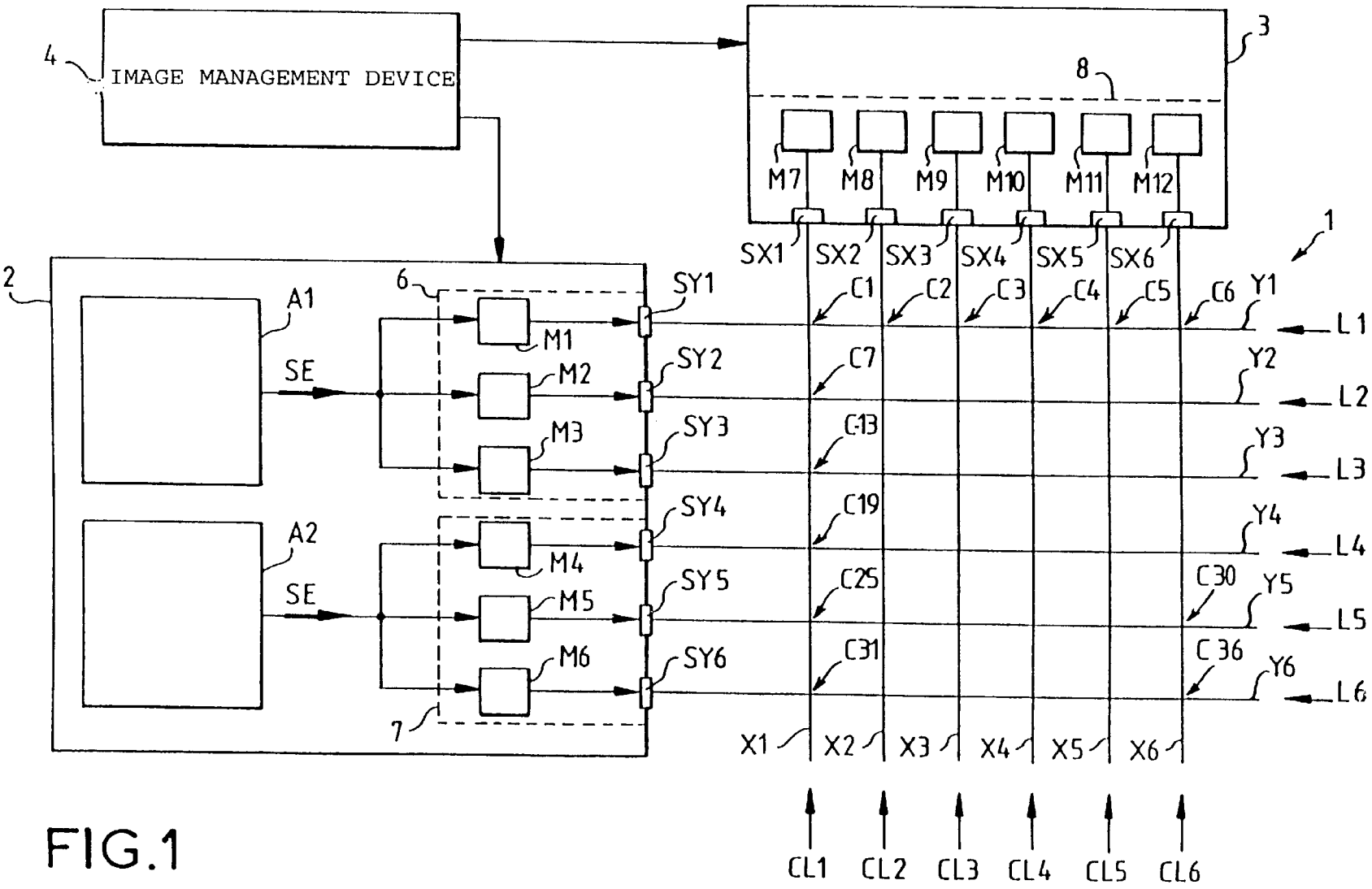
FIG. 1 already described shows diagrammatically a PAP to which the process of the invention may be applied.
Figure 3:
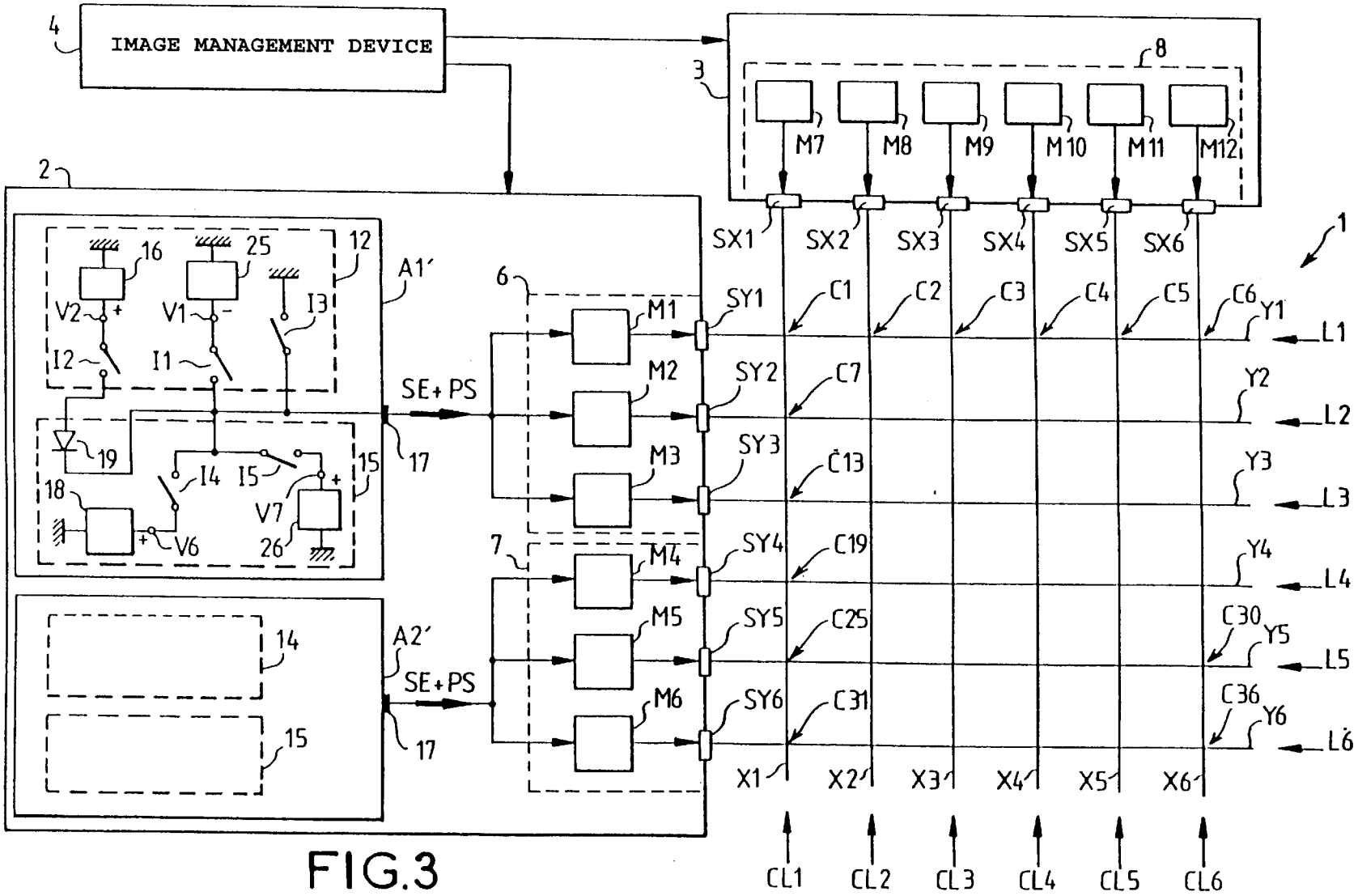
FIG. 3 represents an AC PAP implementing the process.

FIG. 3 represents a PAP similar to that shown in FIG. 1 except as regards its sustain amplifiers A1', A2', which comprise means allowing the implementation of the process of the invention.

Each amplifier A1', A2' comprises a sustain generator 12, 14 which is in itself conventional, producing the sustain signals SE, and in contrast to the amplifiers A1, A2 of FIG. 1, they furthermore include a so-called "superposition" circuit 15 cooperating with the sustain generator so as to superimpose voltage signals referred to as "supplementary porches" PS onto the sustain signals SE at given instants. A sustain generator 12, 14 can for example comprise a first and a second voltage source 25, 16 which are respectively negative and positive, one polarity of which is at the reference potential V0 or earth potential in the example, and the other polarity of which delivers the negative voltage V1 (voltage of the negative strobes 9) in respect of the source 25, and delivers the positive voltage V2 (voltage of the positive strobes 10) in respect of the source 16. The sustain signal SE delivered at the output 17 of an amplifier A1', A2' results from a switching of one of these three potentials onto this output 17; this switching is accomplished with the aid of three switching elements symbolized in the figure by switches I1, I2, I3 respectively switching the negative potential V1, the positive potential V2 and the earth potential.

In the non-limiting example described in which the abovementioned supplementary porches are positive, the superposition circuit 15 comprises a third and a fourth voltage source 18, 26 having a polarity linked to earth; the other polarity of the third and of the fourth source respectively deliver a positive voltage V7 and a positive voltage V6 which corresponds to the amplitude of at least one of the supplementary porches. The voltage V7 is equal to the sum of the positive voltage V2 and of the positive voltage V6 of the supplementary porches. The voltages V6, V7 may be applied to the output 17 of the amplifier Al', A2' with the aid respectively of a fourth and fifth switching element or switch I4, I5. A diode 19 arranged between the output 17 and the fourth voltage source 16 prevents any flow of current in the latter due to the application of the voltage V7. Of course, a similar manner of operation carried out in particular with negative voltage sources 18, 26 would allow the superposition of supplementary porches of negative polarity.

Figures 2A, 2B, 2C, 2D, 2E, 2F:
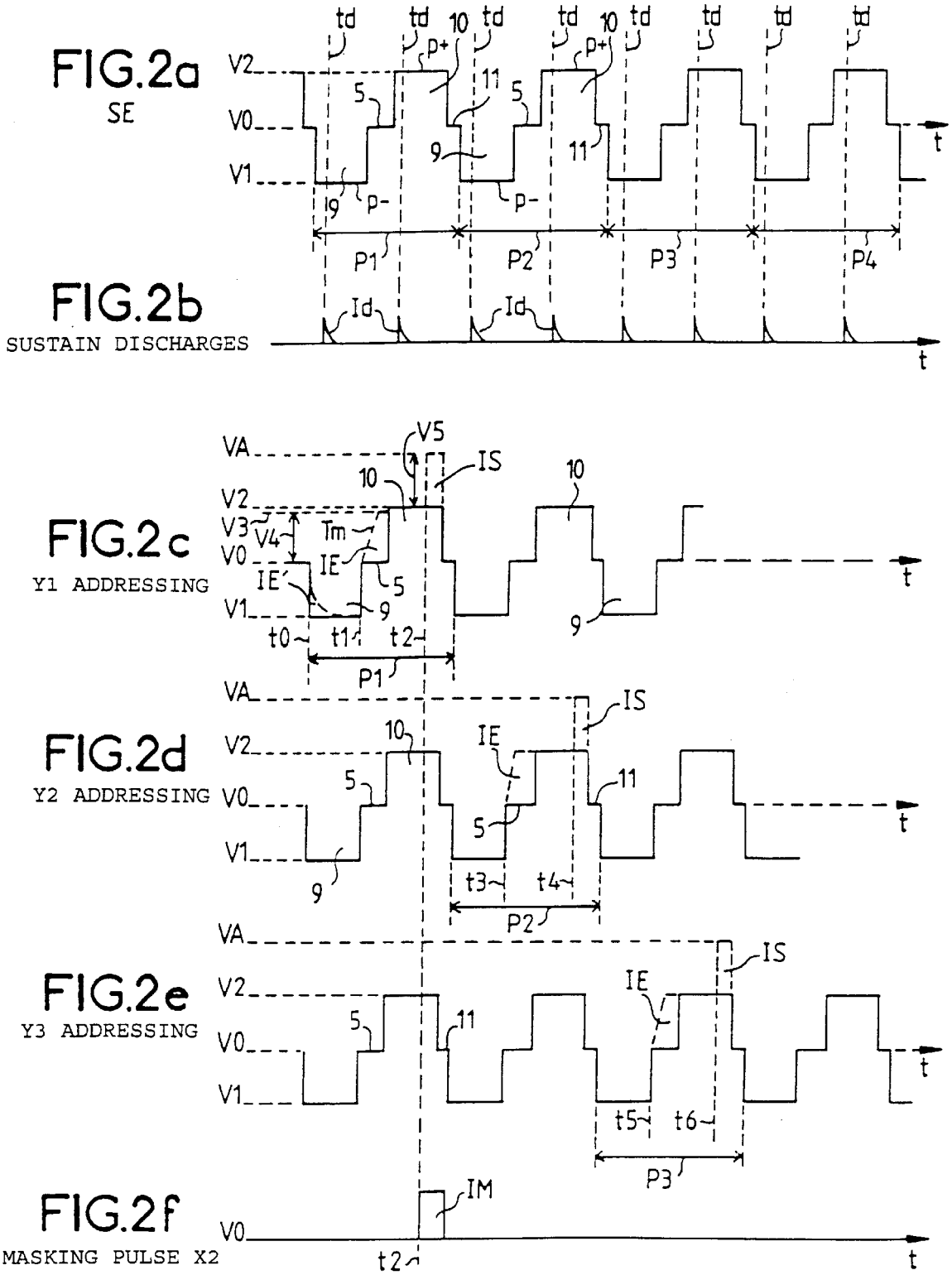
FIGS. 2*a* to 2*f* already described represent signals applied according to a known process to electrodes of the PAP of FIG. 1.

FIGS. 4*a* and 4*g* to 4*j* show signals intended to be applied to line electrodes Y1 to Y6 of the PAP represented in FIG. 3, so as to operate the latter in accordance with the invention. These signals comprise sustain signals SE and erase and write pulses IE, IS, and their shape differs from that of the prior art signals shown in FIGS. 2*a,* 2*c,* 2*d,* 2*e* in that, according to a characteristic of the invention, they furthermore comprise the abovementioned supplementary porches PS1, PS2.

The supplementary porches are superimposed on the sustain signals SE, and the voltage which results from this first superposition forms a voltage base referred to as the addressing base onto which the addressing pulses IE, IS are themselves superimposed. The sustain signals SE consist like those shown in FIG. 2*a* of a succession of negative and positive strobes 9, 10, 9', 10' separated by intermediate porches 5, 5'; they are established with a period P1 to P4 and with respect to a reference potential V0 itself applied to the column electrodes X1 to X6. The supplementary porches PS1, PS2 encompass the entirety of the pulse or pulses for addressing a selected line electrode.

Figures 4A, 4B, 4C, 4D, 4E, 4F, 4G, 4H, 4I:
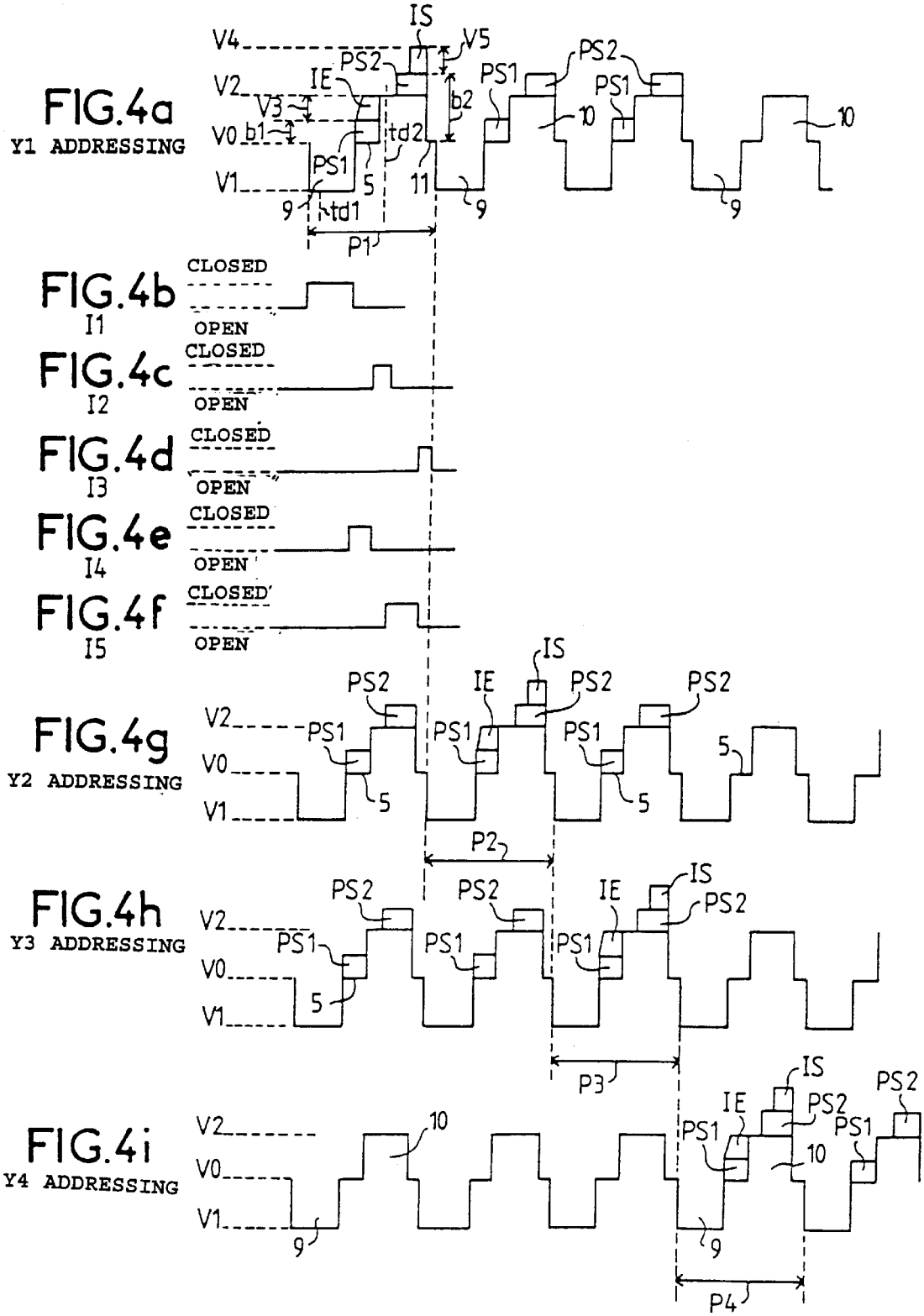
FIGS. 4*a* to 4*j* represent signals applied to the electrodes of the PAP of FIG. 3 in accordance with the process of the invention.

FIG. 4*a* represents an addressing cycle accomplished with regard to the cells formed by the first line electrode Y1, during a period P1. In the non-limiting example described, the supplementary porches PS1, PS2 are positive, they correspond respectively to an erase operation and to a write operation. The first supplementary porch PS1 is superimposed on the sustain signals SE over a wide intermediate porch 5. It has a voltage whose absolute value is below that of the voltage V1, V2 of the strobes. In the example described, the wide intermediate porches 5 being at the reference potential V0, it is only the voltage V6 of the first supplementary porch PS1 which serves as erase base b1 for the erase pulse IE. This voltage V6 has a value of for example 50 volts; by assuming that the erase voltage V4 is of the order of 120 volts, i.e. slightly below those V1, V2 of the negative and positive strobes 9, 10 (of the order of 150 volts), when the erase pulse IE is applied and superimposed on the said base b1, it is sufficient for its amplitude V3 to be of the order of 70 to 80 volts in order for the erase voltage V4 to be obtained, and for the erasure to be carried out. The intermediate porch 5 serving to form the erase base b1 is established between a negative strobe 9 followed by a positive strobe 10.

The second porch PS2 is superimposed over the positive strobe 10. Its voltage V6 is in the example substantially the same as that of the first supplementary porch (it is of course possible if necessary to give different values to the two supplementary porches) and is added to the voltage V2 of this strobe, to constitute a second voltage base b2 intended to receive the write pulse IS. By assuming that the potential difference or writing voltage VA necessary for writing the cells is of the order of for example 270 volts, and that the voltage of the supplementary porches PS1, PS2 is of the order of 50 volts, when the write pulse IS is superimposed on the said second voltage base b2, it is sufficient for it to have an amplitude VS of the order of 70 volts in order for the write voltage VA, that is to say the turn-on voltage, to be obtained.

As far as the first porch PS1 is concerned, it is applied broadly after the instant td1 of the sustain discharge due to the establishment of a negative porch p−, and it is completed before the start of the positive porch p+ which follows and hence before the instant td2 of the discharge which follows. Of course, its amplitude V6 should remain sufficiently below the voltage of the sustain signals SE so as not itself to give rise to any discharge (having regard in particular to the scatter in the characteristics exhibited by the cells).

The second porch PS2 is superimposed on the positive strobe 10, after the instant td2 at which a sustain discharge occurs, and its presence therefore in no way affects the conditions of this discharge. Its amplitude should of course remain limited to a value such that, when added to the voltage V2 of the strobe 10, the resulting voltage remains below that which is able to cause discharges of the write discharges type. In the non-limiting example represented, the second supplementary porch PS2 terminates in phase with the end of the strobe 10: consequently, the voltage transition which follows and which leads to the reference potential V0 has a larger amplitude than that which it would have in the absence of the second supplementary porch PS2, but which has only a slight influence on the sustain discharge arising at the instant td4 which follows, since this discharge is caused by the potential difference engendered with the establishment of the negative strobe 9 belonging to the following period P2. It may be seen that, under these conditions, the superimposition onto the sustain signals SE of the first or of the second supplementary porch PS1, PS2 or of both these porches PS1, PS2 cannot significantly affect the sustain discharges.

Figure 4J:
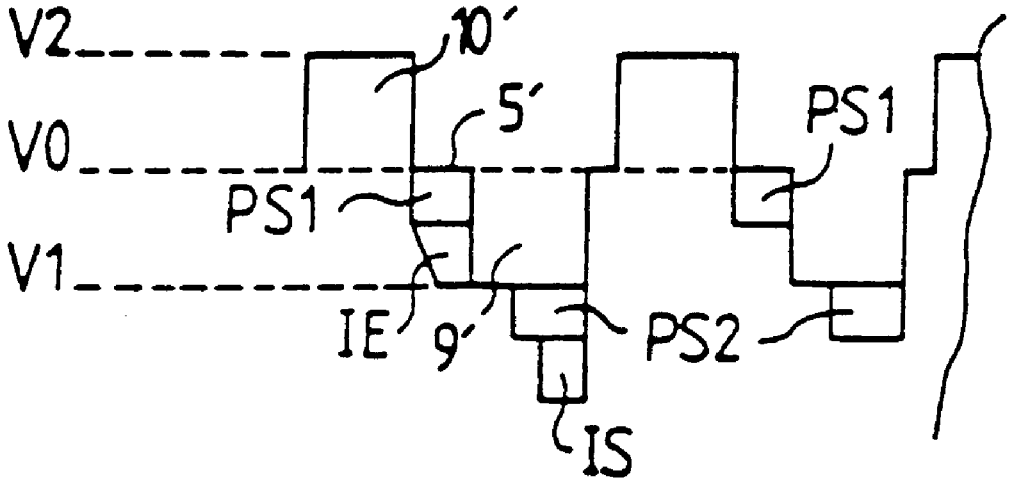

Rather than being positive, the supplementary porches PS1, PS2 and the write pulse IS and erase pulse IE may be negative as illustrated diagrammatically in FIG. 4*j* in respect of the addressing of the line electrode Y1. The first negative supplementary porch PS1 could be added to a wide intermediate porch 5' leading to a negative strobe 9' of the sustain signal SE. A negative erase pulse IE would be added to the First supplementary porch PS1. The intermediate porch 5' serving to form an erase base would be established between a positive strobe 10', followed by a negative strobe 9' of the sustain signal SE. The second negative supplementary porch PS2 would be superimposed on a negative strobe 9' of the sustain signal SE. It would constitute a voltage base b2 to which the likewise negative write pulse IS would be added.

FIGS. 4*b,* 4*c,* 4*d,* 4*e,* 4*f* to be read in conjunction with FIG. 4*a* show respectively the action of the first, second, third, fourth, and fifth switches I1, I2, I3, I4 and I5 and illustrate the operation of a signal generator 12 cooperating with its superposition circuit 15, so as to produce, during the first period P1, the sustain signals SE together with superimposed supplementary porches.

With the start of the period P1, the first switch I1 is "closed" (the other switches are "open") and applies the negative voltage V1 which corresponds to the negative porch p−. At the end of the porch p−, the first switch I1 passes to the "open" state and the fourth switch I4 passes to the "closed" state, this determining the wide intermediate porch 5, together with the first superimposed supplementary porch PS1. At the end of the wide porch 5, the switch I4 passes to the "open" state and the second switch I2 is closed and applies the voltage V2 corresponding to the positive porch p+of the positive strobe 10. The second switch I2 retains its "closed" state until after the instant td2 at which a sustain discharge occurs, then it is open and it is the fifth switch I5 which passes to the closed state and applies the voltage V7 corresponding to the second supplementary porch PS2. At the end of the positive strobe 10, the fifth switch I5 is open and the third switch I3 passes to the closed state and applies the potential of earth; this corresponds to establishing the narrow intermediate porch 11 until the start of the negative strobe 9 which follows and which belongs to a following period P2.

The supplementary porches PS1, PS2 may be formulated and superimposed on the sustain signals in various ways. For example, this can be achieved in a simple manner in each of the sustain generators 12, 14 in such a way that these supplementary porches PS1, PS2 are applied simultaneously and continuously to all the line electrodes Y1 to Y6 of the PAP, or alternatively in such a way that these supplementary porches are applied solely to those of the line electrodes which are linked to a line control circuit 6, 7 currently carrying out an addressing. This latter method corresponds to the example represented with the aid of FIGS. 4*a* and 4*g* to 4*i,* which illustrate the fact that, on the one hand, the sustain signals SE distributed to the line electrodes Y1, Y2, Y3 (all linked to the first line control circuit 6) possess supplementary porches PS1, PS2, and on the other hand that the sustain signals SE applied to the line electrodes Y4, Y5, Y6 (all linked to the second line control circuit 7, and none of which is undergoing addressing) do not possess these porches until the arrival of the day of the month period P4.

The addressings (illustrated in FIGS. 4*h,* 4*g*) on the line electrodes Y2, Y3 are performed during the periods P2, P3 respectively, with the aid of the supplementary porches and of the erase and write pulses IE, IS as explained above.

FIG. 4*i* represents the addressing performed at the period P4 which follows, on the fourth line electrode Y4 which it depends of the second line control circuit 7. In the non-limiting example represented, the period P4 is that onwards of which the superposition of the supplementary porches PS1, PS2 onto the sustain signals SE distributed to the electrodes Y1 to Y3 ceases, and where conversely this superposition starts on the signals SE distributed to the electrodes Y4 to Y6. The addressing on the line electrode Y4 as well as those addressings (not represented) performed subsequently at periods which follow on the electrodes Y5, Y6 are performed in the same manner as explained above, by superimposing supplementary porches and erase and write pulses IE, IS.

Such a manner of operation therefore makes it possible, as compared with the prior art: to use line control circuits of lower performance, on the one hand owing to the reduction in the amplitudes of the addressing pulses IS, IE, and on the other hand owing to the fact that the supplementary porches PS1, PS2 which compensate for this amplitude reduction pass through the line control circuits 6, 7 through the same pathway as the sustain signals SE.

This manner of operation furthermore makes it possible, through the superimposing of the erase and write pulses IE, IS onto already established supplementary porches PS1, PS2, as well as through the reduction in the amplitude of these pulses, to reduce the capacitive consumption due to the application of these pulses. This reduction in capacitive consumption is especially manifest when the addressing frequency is very high, in particular in the addressings of the so-called "multiple pulse" type, in which may be found a large number of selective-addressing pulses (usually in write mode) on one and the same strobe. Accordingly, the process of the invention makes it possible to reduce the amplitude of a large number of these pulses by superimposing a single supplementary porch.

Figure 5:
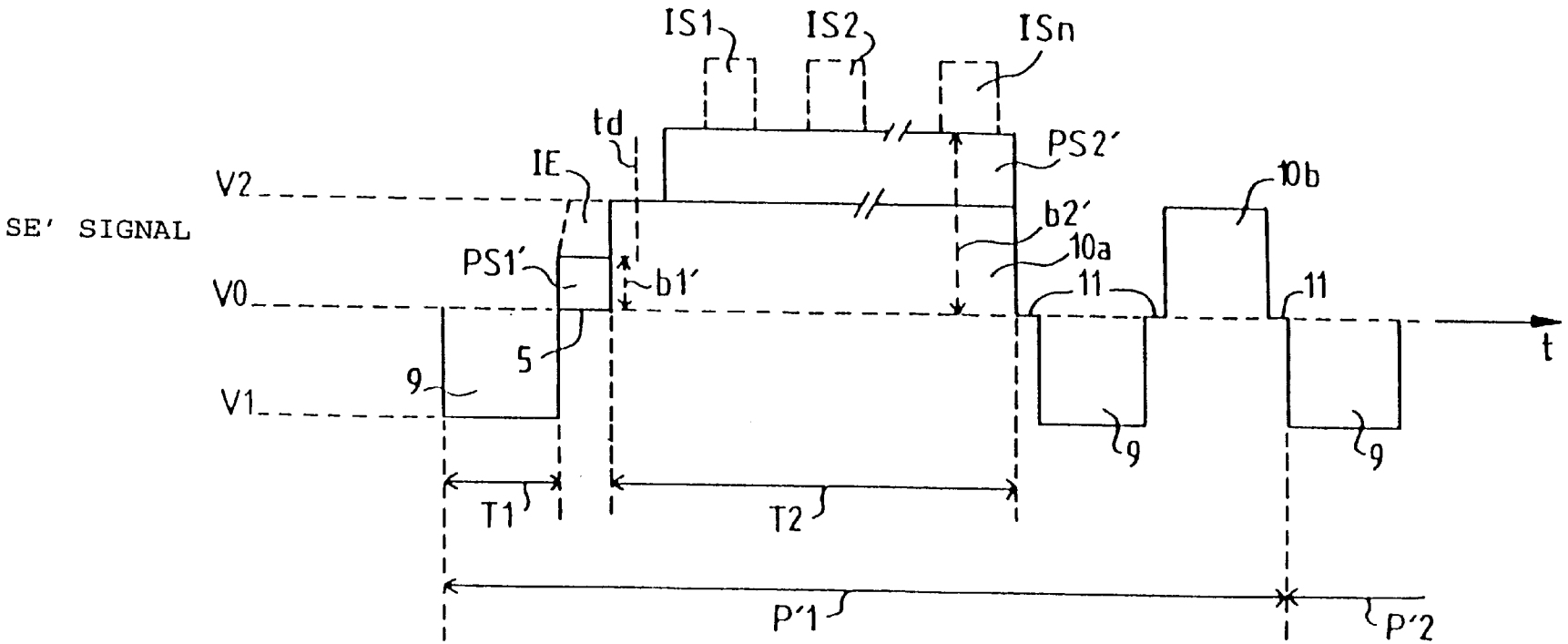
FIG. 5 represents sustain signals in the case of an addressing of the so-called multiple type.

FIG. 5 represents the shape of the sustain signals SE' for such a case of "multiple pulse" addressing. In the example of FIG. 5, a period P' 1 of the signals SE' making it possible to perform an addressing cycle starts with a negative strobe 9, followed by a positive strobe 10*a* from which it is separated by a wide intermediate porch 5 formed at the level of the reference potential V0; this positive strobe 10*a* is followed by a narrow intermediate porch 11 preceding another negative strobe 9 which is itself followed by a narrow porch 11; next comes a narrow positive strobe 10*b*, and then finally a narrow intermediate porch 11 which precedes a negative strobe of a following period P2'. It should be noted that the sole function of the last negative and positive strobes 9, 10*b* being to cause sustained discharges, no supplementary porch is superimposed on them.

In the example represented, the negative strobe 9 has a duration T1 which is much less than the duration T2 of the positive strobe 10*a*, which duration T2 corresponds to the time required to carry out the selective addressing of the cells formed along several line electrodes generally controlled by the same line control circuit, as is the case for example for the groups of line electrodes Y1 to Y3 and Y4 to Y6, these groups being controlled by the control circuits 6, 7 respectively.

It should be noted that control circuits of the type of the circuits 6, 7 are commonly found which have several outputs each linked to a line electrode.

Each of these control circuits can have for example 32, 40, 64 or even 128 outputs.

As many outputs must be provided as the number n of line electrodes. These control circuits make it possible:

on the one hand, to apply, to one or simultaneously to several selected electrodes or to n electrodes, for example an erase pulse IE which may in the prior art be superimposed directly on a wide intermediate porch 5, so as to simultaneously erase all the cells of all the electrodes to which it is applied;

on the other hand, receiving a string of write pulses IS1, IS2, IS3, . . ., ISn, these control circuits employ means which allow them to distribute each write pulse to a line electrode, one electrode after another; these write pulses are each superimposed on the same positive strobe of the signals SE, at different instants along this strobe. The writing of the cells of the n line electrodes may thus be accomplished with the aid of a single strobe 10*a*, at high speed.

This organization according to the prior art is illustrated FIG. 5 in which, in addition, and according to the invention, there is at least one supplementary porch serving for the erase pulse IE and/or for the write pulses IS1 to ISn. In the example represented, a first supplementary porch PS1', having for example the same shape and the same value as those of the first porch PS1 shown in FIG. 4*a* (assuming that the strobes of the sustain signals SE of FIG. 4*a* have the same value V1, V2 as those of the signals SE' of FIG. 5) is superimposed on the wide intermediate porch 5 contained in the period P' 1. Hence, an erase pulse IE (symbolized in FIG. 5 by dashed lines) having the same value as that of FIG. 4*a* can be superimposed on the base b1' consisting of this supplementary porch, so as to carry out the erasure.

A second supplementary porch PS2' is superimposed on the first positive strobe 10*a*, after the instant td at which the sustain discharge produced by the establishment of this strobe occurs. This second supplementary porch PS2' lasts till the end of the positive strobe 10*a*, and its voltage value may be the same as that of the second supplementary porch PS2 shown in FIG. 4*a*. Writes may therefore be obtained by superimposing write pulses IS1, IS2, . . ., ISn, on the voltage base b2' resulting from the voltages of this supplementary porch PS2' and the positive strobe 10*a*, and by distributing these signals to the line electrodes as explained above.

It is also conceivable, in the case of "multiple pulse" addressing, for the supplementary porches PS1, PS2 to be negative and for them to be added respectively to an intermediate porch and to a negative strobe of the sustain signal. A negative erase pulse would be added to the first supplementary porch PS1 and several write pulses would be added to the second supplementary porch PS2.

FIGS. 6*a*, 6*b*, 6*c* represent another way of compensating for the reduction in the amplitude of the write and erase pulses, this way consisting in modifying the voltage applied to the column electrodes X1 to X6, or at least to those of these electrodes which define an addressed cell.

FIG. 6*a* represents a period P' 1 of sustain signals SE' similar to those of FIG. 5 (that is to say allowing addressing of the "multiple addressing" type), which period illustrates an addressing sequence performed according to this new version of the process of the invention. These signals comprise a negative strobe 9 and a positive strobe 10*a* which are separated by a wide intermediate porch 5. This porch 5 and this strobe 10*a* are intended to receive, respectively, an erase pulse IE and write pulses IS1, IS2, with no prior superposition of supplementary porches.

FIG. 6*b* represents variation of a voltage VX applied to a column electrode, the second electrode X2 for example (this example holding for all the other column electrodes X1 to X6); these variations are due to signals consisting on the one hand of masking pulses IM (which oppose the execution of an addressing), and on the other hand of so-called "confirmation" pulses or strobes 30, 31 which on the contrary favour the execution of the addressing. In the absence of these pulses, the voltage VX applied by the output SX2 to the electrode X2 has a value VX0 corresponding to the reference potential V0.

When the erase pulse IE is superimposed on the wide porch 5, the resulting voltage reaches a value V3 (of 80 volts for example) which is below that of the voltage V4 (of the order of 120 volts) required to accomplish erasure. The difference V4−V3 is then compensated for by the voltage VX applied to the electrode X2: with this objective, a negative strobe forming an erase confirmation pulse 30 having an amplitude Vce (of the order of 40 volts for example) is then applied (in phase with the erase pulse IE), causing the voltage VX to pass to a value −VX. The effect of this is to increase the potential difference applied to the terminals of the cells to be "erased" until it is made to reach the value of the erase voltage V4. The column voltage VX then re-attains the value of the reference potential V0 until the write phase, or at least until after the instant td at which a sustain discharge occurs.

The confirmation pulses have an amplitude equal to or greater than a difference between the addressing voltage and the voltage which on the selected line electrode results from the addressing pulse.

By assuming on the one hand that this write phase comprises a first and a second write pulse IS1, IS2 which are consecutive (applied to different line electrodes), having an amplitude V5 such that when these pulses are superimposed on the positive strobe 10*a,* the resulting voltage V2+V5 is below the value VA required for writing; by assuming on the other hand that a cell defined by the second column electrode X2 has to be set to the written state by the first pulse IS1, a negative strobe 31 constituting a write confirmation pulse having an amplitude Vci (of the order of 40 volts for example) is then applied to the second electrode X2 (in phase with the first write pulse IS1). Consequently, the voltage VX on this column passes to the negative value −VX, and this variation in the voltage VX increases the potential difference applied to the cell until it is made to reach the value VA required for writes.

Assuming lastly that another cell defined by the second column electrode X2 has to retain an "erased" state despite the application of the second write pulse IS2: it is sufficient to apply to the column electrode X2 (in phase with the second write pulse) a strobe which is positive with respect to the potential V0 (of the order of 40 volts), so as to make the voltage VX on the column electrode pass to a positive value +VX and constitute a masking pulse IM1.

The manner of operation described with reference to FIG. 6*b* requires that means of switching and/or of pulse superposition of the column control circuit 8 be organized so as to allow it to deliver as output SX1 to SX6, pulses which are positive and negative with respect to a mid-point (earth for example).

FIG. 7 diagrammatically represents such an organization, in which the closing of a first or of a second or of a third switch element I'1, I'2, I'3 causes respectively the application to a column electrode X1 to X6, of the earth, of the negative voltage −VX, of the positive voltage +VX. In the non-limiting example described, the earth here constitutes the reference potential with respect to which the voltages of the sustain signals are alternately positive and negative, but also constitutes the reference voltage V0'1 specific to the operation of the elements of the column control circuit 8, and with respect to which voltage the pulses 30, 31 and IM1 are delivered.

FIG. 6*c* illustrates another method for carrying out the same addressing sequence as that of FIG. 6*b* with addressing pulses IE, IS1, IS2 of reduced amplitude, which makes it possible to use the outputs of the column control circuit 8 in a manner which is more in keeping with its most common capabilities, and in which the reference voltage V0'1 specific to the control circuit 8 is always negative with respect to the pulses 30, 31, IM1 delivered.

Before the start of the wide intermediate porch 5 to which the erase pulse IE is applied (FIG. 6*a*), the voltage VX on the column electrode X2 possesses the value VX0 corresponding to the reference potential V0, but which also corresponds to the first reference voltage V0'1 specific to the operation of the column control circuit 8. When the wide intermediate porch 5 occurs, the confirmation strobe or pulse 30 which is constructed on the voltage VX results from a change of reference voltage specific to the control circuit: indeed, via switching (not represented, within the scope of any expert in the field), the first reference voltage V0'1 specific to the circuit 8 is replaced with a second reference voltage V0'2 which is negative with respect to the first and which corresponds to the value of the negative voltage −VX. This second reference voltage V0'2 is retained up to the start of the positive strobe 10*a* which follows, onwards of which it is substituted by the first reference voltage V0'1, so as to bring about the end of the erase confirmation pulse 30 before the instant td of a sustain discharge and not to risk modifying the conditions of the latter. The erase confirmation is thus as it were built into the reference voltage.

After this instant td of a discharge, and in phase or before the application of the first write pulse IS1, the second reference voltage V0'2 again replaces the first so as to produce the write confirmation pulse 31. The first reference voltage V0'1 is then substituted for the second reference voltage V0'2 so as to form the end of this write confirmation. Next, before or in phase with the second write pulse IS2, a positive pulse is applied with respect to the value VX0 which represents the reference potential V0 as well as the first reference voltage specific to the circuit 8, which positive dulse constitutes a masking pulse IM1 and which, over its duration, confers the value +VX on the voltage VX.

It should be observed that the compensations for potential differences effected at the level of the voltage applied to the column electrodes X1 to X6, as described above, are especially advantageous as regards the reducing of the capacitive power (owing in particular to the fact that they lead to a large reduction in the amplitude of the masking pulses) since the capacitance seen by the pulses distributed over the columns X1 to X6 is much larger than that encountered on the line electrodes Y1 to Y6.

Of course, the reduction in the amplitude of the addressing pulses IE, IS may also be compensated for by combining the amplitude of the supplementary porches with the amplitude of the confirmation strobes.

This description of the process of the invention and of the means which are useful for its implementation has been made with reference to an AC PAP using only two crossed electrodes to define a cell, but the invention nevertheless applies to all types of AC PAPs, including those of the so-called "coplanar sustain" type. In this latter type of PAP in fact, the problems related to the amplitude of the addressing pulses are the same, and the solutions described above apply in the same way since the addressing is performed with the aid of two crossed electrodes, one of which receives sustain signals, as described herein.

What is claimed is:

1. Control process for addressing an AC plasma panel comprising at least one network of line electrodes, crossed with at least one network of column electrodes, cells being formed at the intersections of the line and column electrodes, said process comprising:

applying to all the line electrodes, sustain signals made of a succession of strobes established with a given period with respect to a reference potential applied to the column electrodes, each period comprising an addressing cycle comprising at least one semi-selective addressing and at least one selective addressing, each type of addressing comprising applying to at least one selected line electrode an addressing pulse whose voltage is added to a line voltage already present on this electrode, with a view to applying to the terminals of cells formed by this selected electrode an addressing voltage of given value corresponding to the addressing to be performed, wherein for at least one of the semi-selective addressing and the selective addressing, the addressing pulse has an amplitude below that which is appropriate for obtaining the required addressing voltage, and in that to obtain the required addressing voltage, the process comprises one of: (1) modifying the reference potential applied to the column electrodes, (2) modifying the line voltage already present on the selected line electrode when the addressing pulse is applied, and (3) in modifying the line voltage as well as the reference potential applied to the column electrodes.

2. Process according to claim 1, wherein the semi-selective and selective addressings respectively comprise erasures and writings of cells.

3. Process according to claim 1, comprising superimposing at least one voltage porch referred to as the supplementary porch on the sustain signals to form a voltage base referred to as the addressing base onto which is superimposed at least one addressing pulse.

4. Process according to claim 3, wherein the supplementary porches are positive or negative voltage porches added to the sustain signals.

5. Process according to claim 1, the sustain signals being formed of negative and positive strobes, the process comprising forming a write addressing voltage base with a strobe, and of superimposing an addressing pulse comprising a write pulse onto the write addressing voltage base.

6. Process according to claim 3, comprising establishing between two consecutive strobes an intermediate porch having a voltage below the voltage of the strobes, and in adding a supplementary porch to the said intermediate porch to form an erase addressing base, then in superimposing an addressing pulse comprising an erase pulse onto the erase addressing base.

7. Process according to claim 6, wherein the intermediate porch serving to form an erasure base is established between a negative strobe followed by a positive strobe.

8. Process according to claim 6, wherein the intermediate porch serving to form an erasure base is established between a positive strobe followed by a negative strobe.

9. Process according to claim 1, wherein the supplementary porches are added onto strobes, being superimposed on the strobes after an instant at which a sustain discharge occurs.

10. Process according to claim 9, wherein the supplementary porches formed on the strobes are deleted substantially at the end of the strobes.

11. Process according to claim 3, comprising superimposing several addressing pulses onto the same addressing base.

12. Process according to claim 1, wherein the supplementary porches formed on the strobes encompass an entirety of the pulse or pulses for addressing the selected line electrode.

13. Process according to claim 6, wherein the erase addressing base has an amplitude equal to or greater than the difference between an erasure voltage and the amplitude of the erase pulses.

14. Process according to claim 5, wherein the write addressing voltage base has an amplitude equal to or greater than the difference between a writing voltage and a voltage value formed by the sum of the voltage of a positive strobe and of the amplitude of a write pulse.

15. Process according to claim 6, wherein the intermediate porch is at a same voltage as the reference potential.

16. Process according to claim 1, wherein the sustain signals are formulated by at least one sustain amplifier and then applied to a line control circuit so as to be distributed to the line electrodes, and wherein the supplementary porches are superimposed on the sustain signals before being applied to the line control circuit.

17. Process according to claim 16, comprising distributing the sustain signals to the line electrodes via at least two line control circuits, and applying sustain signals together with superimposed supplementary porches only to that of the control circuits which controls a line electrode for which an addressing is in progress.

18. Process according to claim 1, wherein for at least one of the addressings the process comprises modifying the reference potential applied to the column electrodes in synchronism with the addressing pulses, by superimposing confirmation pulses, having a polarity opposite to those of the addressing pulses, onto the said reference potential.

19. Process according to claim 18, wherein, for the selective addressing, the process comprises superimposing either a confirmation pulse or a masking pulse of polarity opposite to that of the confirmation pulse onto the said reference potential.

20. Process according to claim 18, wherein the confirmation pulses have an amplitude equal to or greater than a difference between the addressing voltage and the voltage which on the selected line electrode resulting from an application of the addressing pulse.

21. Process according to claim 18, wherein the reference potential applied to each column electrode is delivered by a column control circuit having n outputs, each output being capable of delivering negative pulses and positive pulses with respect to the reference potential.

22. Process according to claim 18, wherein the reference potential applied to each column electrode is delivered by a column, control circuit having n outputs, each output being capable of delivering negative pulses and positive pulses with respect to the reference potential, and in that one or other of these two pulse types results from a modification of a reference voltage specific to an operation of the column control circuit.

23. Plasma panel of AC type implementing the process according to claim 1, comprising at least one network of line electrodes crossed with at least one network of column electrodes, a column management device linked to the column electrodes, a line management device comprising at least one sustain amplifier delivering sustain signals applied to the line electrodes by way of a line control circuit, cells being formed at the intersections of the line and column electrodes, semi-selective addressing pulses and selective addressing pulses being superimposed on the sustain signals so as to apply to the terminals of selected cells an addressing voltage having a given value depending on the addressing to be performed, wherein for at least one of the semi-selective and selective addressing, the line management device or the column management device or the two devices comprise means for creating a voltage which is added to a voltage resulting from superimposing the addressing pulse onto the sustain signals.

24. Plasma panel according to claim 23, wherein the line management device comprises a superimposing circuit configured to superimpose supplementary porches onto the sustain signals.

25. Plasma panel according to claim 24, wherein the sustain amplifier cooperates with the superimposing circuit to superimpose the supplementary porches onto the sustain signals before applying the supplementary porches to the line control circuit.

* * * * *